United States Patent [19]

Yoshikawa et al.

[11] 4,276,239

[45] Jun. 30, 1981

[54] VARIABLE AIR VALVE CARBURETOR

[75] Inventors: Katsushi Yoshikawa, Yokohama; Masaaki Saito, Yokosuka; Tadaki Ota; Mitsumasa Inoue, both of Yokohama, all of Japan

[73] Assignee: Nissan Motor Company, Limited, Yokohama, Japan

[21] Appl. No.: 86,312

[22] Filed: Oct. 19, 1979

[30] Foreign Application Priority Data

Oct. 19, 1978 [JP] Japan ..... 53-128857

[51] Int. Cl.[3] ..... F02M 7/22

[52] U.S. Cl. ..... 261/44 E; 261/50 A; 261/DIG. 38

[58] Field of Search ..... 261/50 A, 44 C, DIG. 38, 261/44 E; 24/261 R

[56] References Cited

U.S. PATENT DOCUMENTS

| | | | |
|---|---|---|---|
| T962,010 | 4/1968 | Newbury et al. | 261/44 C |
| 1,454,254 | 5/1923 | Roney | 24/261 R |
| 1,875,557 | 9/1932 | Brown | 261/44 B |
| 1,995,587 | 3/1935 | Schuttler | 261/50 A |
| 2,099,553 | 11/1937 | Atkins | 261/50 A |
| 2,583,406 | 1/1952 | Arnold | 261/50 A |
| 2,843,653 | 7/1958 | Mix | 24/261 R |
| 2,855,283 | 10/1958 | Schumacher | 261/50 A |
| 3,082,897 | 3/1963 | Highley | 24/261 R |
| 3,236,506 | 2/1966 | Mennesson | 261/50 A |
| 3,322,408 | 5/1967 | Stoltman | 261/50 A |
| 3,392,965 | 7/1968 | Harrison | 261/50 A |
| 3,754,739 | 8/1973 | Buike et al. | 261/50 A |
| 4,000,226 | 12/1976 | Laprade et al. | 261/50 A |
| 4,034,029 | 7/1977 | Tipton | 261/DIG. 38 |
| 4,046,121 | 9/1977 | Pierlot | 261/50 A |

FOREIGN PATENT DOCUMENTS

| | | | |
|---|---|---|---|
| 14552 | 11/1971 | Australia | 261/50 A |
| 2625978 | 12/1976 | Fed. Rep. of Germany | 261/44 C |
| 718381 | 11/1954 | United Kingdom | 261/50 A |

*Primary Examiner*—Tim R. Miles

*Attorney, Agent, or Firm*—Schwartz, Jeffery, Schwaab, Mack, Blumenthal & Koch

[57] ABSTRACT

A carburetor with a circular air valve, in which the fuel metering needle is connected to a bracket on the downstream face of the air valve.

13 Claims, 10 Drawing Figures

VARIABLE AIR VALVE CARBURETOR

BACKGROUND OF THE INVENTION

The present invention relates to an improved carburetor, and, more particularly, to an improved air valve carburetor in which the air valve is a circular valve pivoted around one of its diameters.

Variable air valve type carburetors are known for providing fuel-air mixture for internal combustion engines. Their construction is complicated, but they possess good metering, particulation, and atomization characteristics, over a wide range of air flow amounts.

FIGS. 1, 2, and 3 show various prior art air valve carburetors. In these carburetors, an air valve 3 is provided upstream of a throttle valve 1, and the air valve 3 is controlled by a diaphragm device 2 according to the vacuum between the air valve 3 and the throttle valve 1, in a feedback manner, so as to maintain this vacuum level always substantially constant. Further, a jet needle 5 is inserted into a fuel nozzle 4, through which fuel is sucked by this vacuum Po between the air valve 3 and the throttle valve 4. The jet needle 5 is moved by the motion of the air valve 3, so that the effective cross-sectional area of the nozzle 4 is increased along with the opening of the air valve 3, so as to control the flow of fuel in direct proportion to the flow of intake air, thereby maintaining a constant air/fuel ratio.

In the carburetors shown in FIGS. 1 and 2, the air valves 3 have rectangular vanes 3*a* and 3*b*. In FIG. 1 the base of the vane 3*a* is pivoted to the side of the air passage 6; and in FIG. 2 the arm portion of the vane 3*b* is pivoted to the wall of the carburetor body 7. In both of these carburetors, it is difficult to control precisely the air/fuel ratio, because the aperture for the rotation of the vanes 3*a* and 3*b* cannot be precisely set, and the quality thereof is rather unstable.

In the carburetor of FIG. 3, the air valve is a circular plate which is pivoted about one of its diameters. Thus the abovementioned problem is overcome. However, the complicated link mechanism 8 for linking the jet needle 5 and the air valve 3 means that changes of the mechanism over time, such as caused by wear, affect badly the control of the air/fuel ratio, resulting in problems reating to durability of the carburetor, and the like.

Because of the fact that the momentum force about the supporting axis of vanes of FIGS. 1 and 2 caused by the air stream are not balanced, there is a risk that these vanes may be disturbed, bent, or broken, due to the large momentum force which occurs during accelation or backfiring of the engine.

SUMMARY OF THE INVENTION

Therefore, an object of the present invention is to provide an air valve carburetor wherein the air flow is well balanced dynamically, and the air valve has a good flow control characteristic, and in which the linkage mechanism between the air valve and the jet needle is improved, so as to avoid changes over time of the precision of control of the air/fuel ratio, so that reliability of operation is increased.

Another object of the invention is to provide such a carburetor in which the characteristics of the proportioning of the actuating vacuum at the air valve, and the particulation of the fuel at low flow rates, are greatly improved, so as to increase the precision of the control of the air/fuel ratio.

According to the present invention, these and other objects are attained by an air valve carburetor for an internal combustion engine, comprising: a body; an intake passage formed in the body, circular in cross-section, leading to the engine; a circular throttle valve mounted rotatably in the intake passage about one of its diameters; a circular air valve mounted upstream of the throttle valve rotatably in the intake passage about one of its diameters, and controlled so as to open in response to vacuum between it and the throttle valve, so as to maintain that vacuum substantially constant; a fuel nozzle opening into the intake passage between the throttle valve and the air valve; and a tapered needle, one end of which is inserted into the fuel nozzle so that it co-operates with the nozzle to provide a fuel opening which is varied in effective cross-section, as it moves in and out of the nozzle; and means is provided fixed to the back of the air valve for pivotally supporting the other end of the needle.

BRIEF DESCRIPTION OF THE DRAWINGS

The present invention will become more fully understood from the following description of several preferred embodiments thereof, and from the accompanying drawings which are illustrative of the embodiments. In the drawings.

DESCRIPTION OF THE PREFERRED EMBODIMENTS

Figure 1:
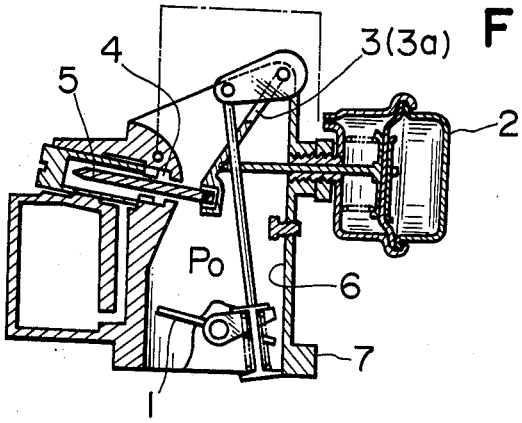
FIGS. 1, 2, and 3 show various prior art air valve carburetors.
Figure 2:
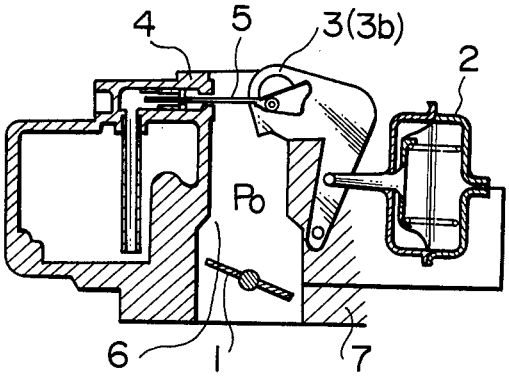
Figure 3:
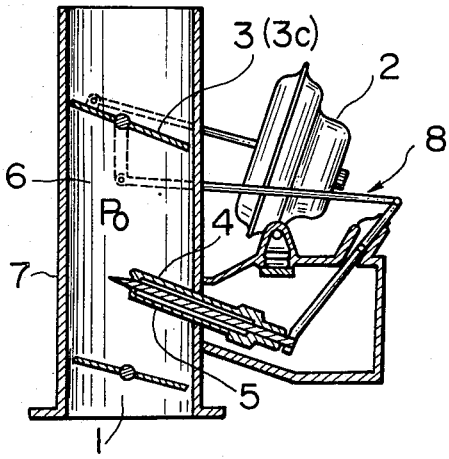

Referring to FIGS. 4, 5A, 5B, and 5C, in which the structure of the first embodiment of the present invention is shown, 10 designates the main body of the carburetor. The intake air passage 11 is circular in section, and an air valve 12, circular in shape, is mounted rotatably about one of its diameters in the intake passage 11. Downstream of the air valve 12 in the intake passage 11 is mounted a throttle valve 13, which also is circular in shape and is mounted pivotably about one of its diameters.

The air valve 12 is mounted about the shaft 12*a*, and to the end of this shaft 12*a* is fixed a valve lever 12*b*. To the other end of the valve lever 12*b* is connected a vacuum actuating device such as a diaphragm device 14 which includes an actuating rod 14*a* connected to the end of the valve lever 12*b*. This diaphragm device 14 includes a housing fixed to the carburetor body 10 and a vacuum chamber, not shown, into which the vacuum Po in the intake passage between the air valve 12 and the throttle valve 13 is introduced through the vacuum supply passage 14*b*. Thereby, the amount of opening of the air valve 12 is controlled by the diaphragm device in a feedback manner, so as to maintain the vacuum Po substantially constant.

According to the present invention, a bracket 15 is provided on the back of the air valve 12, and the tip of a tapered jet needle 16 is pivoted to this bracket 15. The jet needle 16 enters into the fuel nozzle 17, and, as the air valve 12 revolves, this needle 16 is moved in and out of the fuel nozzle 17, and, because the needle 16 is tapered from its thickest portion away from the air valve 12 to its thinnest portion nearer to the air valve 12, thereby the flow of fuel through the fuel nozzle 17 is metered. Thus the amount of fuel flow is kept substantially proportional to the amount of air flow.

Although the needle 16 is tilted somewhat to and fro as it moves in and out of the nozzle 17, the construction of the nozzle 17 as seen in the figure is able to cater for this, so that the needle 16 still moves smoothly.

It is preferable to tilt the fuel nozzle 17 so that its front end, which is in the intake passage, is lower than its other end. It is thereby arranged and ensured that the needle 16 can move smoothly in the nozzle 17, over its entire range of motion, from the closed position of the air valve 12, to its full open position.

Figure 5A:
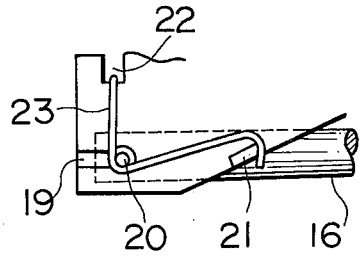
FIG. 5A is a side view, showing the joining structure of a bracket and a needle, in the carburetor of FIG. 4.
Figure 5B:
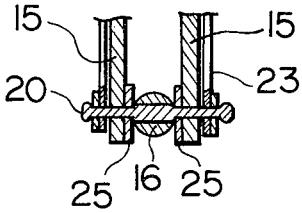
FIG. 5B is a sectional view of the structure shown in FIG. 5A.

FIGS. 5A and 5B particularly illustrate the way in which the fuel needle 16 is pivoted to the bracket on the back of the air valve 12, according to the present invention.

Figure 5C:
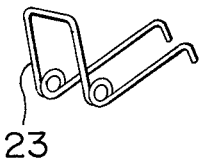
FIG. 5C is a perspective view of a clip in the structure shown in FIGS. 5A and 5B.

Two brackets 15, formed as triangles, are fixed in parallel by screws 18 to the back of the air valve 12. Notches 19 and 22 are formed as shown in these brackets. In the end of the needle 16 is pierced a hole, and a joint pin 20 passes through this hole, and its ends rest in the notches 19 so that it can turn in them. The spring 23 is engaged around these ends of the pin 20 and stops them coming out of the notches 19, by biasing them towards the bottoms of the notches. That is, the one ends of the spring 23 are supported on the stoppers 21 of the brackets 15, and the other end of the spring (its central portion, in fact) is supported in the notches 22. The intermediate portions of the spring 23 are wound around the ends of the pin 20, and thereby this pin 20 is biased. FIG. 5C shows the spring 23 in detail. Further, shims 25 made of polytetrafluorethylene such as Teflon (trademark) are fitted between the sides of the bracket 15, and the needle 16.

Figure 4:
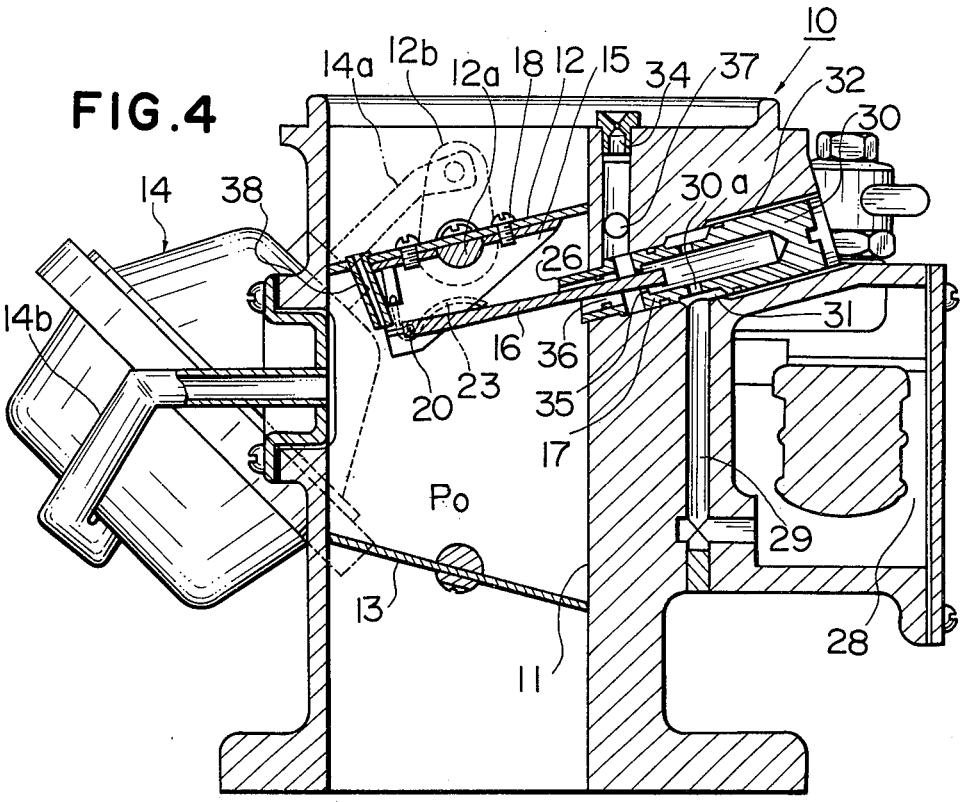
FIG. 4 is a sectional view of a first embodiment of the air valve carburetor of the present invention.

In the embodiment of FIG. 4, the end of the fuel nozzle 17 protrudes into the intake passage so as to constitute a cover 26, the under side of which is cut away, so as to improve the precision of intake of fuel.

The float chamber 28 is connected with the fuel nozzle 17 through the passage 29, the circular groove 31, and the opening 30*a*. The groove 31 is formed on the outside of the nozzle body 30. The surface of the fuel in the float chamber is set to be lower than the front end of the nozzle 17.

The nozzle body 30 is screwed into the carburetor body 10 by its surrounding screw portion 32.

An air bleed 34 is communicated with the fuel nozzle 17, downstream of the fuel metering portion thereof, so as to supply air to be mixed with the fuel supplied therethrough, thereby improving the fuel particulation. 36 denotes a nozzle orifice. A control air bleed 37 is connected with the air bleed 34 for the purpose of the precise adjusting of the air supply rate.

An air passage pipe 38 is provided on the air valve 12, near the point where the needle is joined to the brackets is, so as to provide a flow of air through the air valve 12 even when it is closed, so as to blow away and particulate fuel dribbling down the needle 16.

This carburetor functions in the same way as a conventional air valve carburetor. Because the variable air valve 12 and the needle 16 are conntected through the bracket 15 and the pin 20, according to the present invention, their operation is smooth, and the area of friction is small. Therefore wear is slow, and the carburetor functions smoothly for a long time.

Air blowing through the pipe 38 blows away any fuel dribbling down the needle 16, as a spray.

Further, the air mixed by the air bleed 34 into the fuel being sucked from the fuel nozzle 17 ensures good particulation of this fuel.

Figure 6:
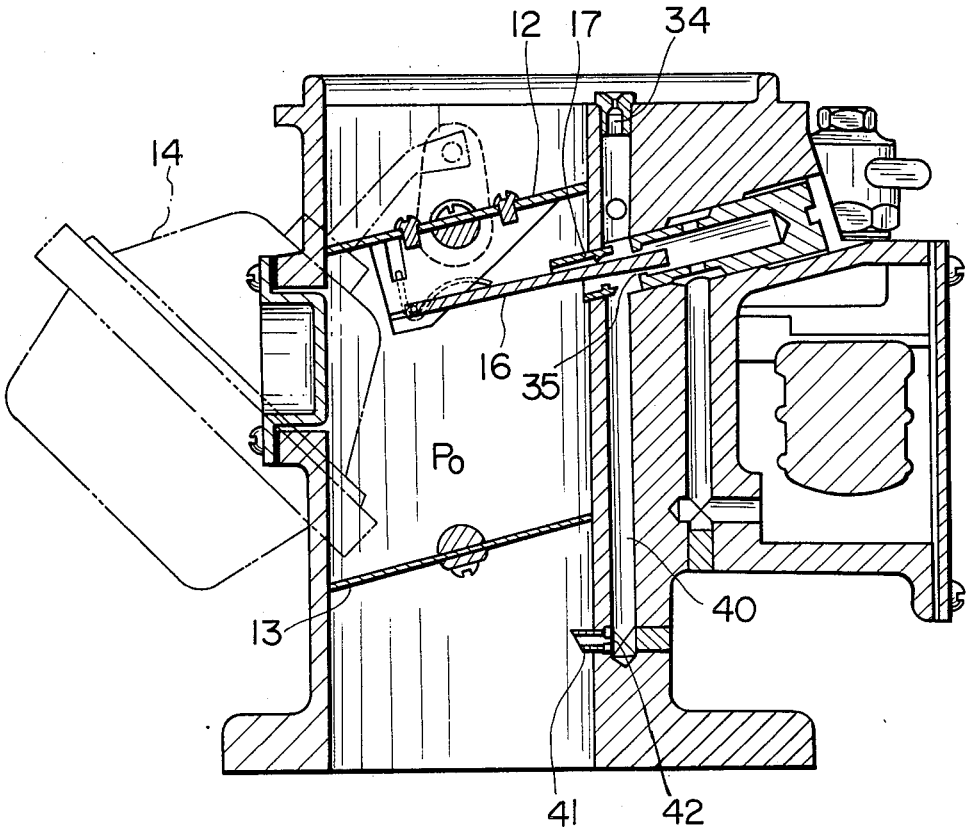
FIG. 6 is a sectional view of a second embodiment of the air valve carburetor of the present invention.

FIG. 6 shows a second embodiment of the air valve carburetor according to the present invention. In this air valve carburetor, an auxiliary passage 40, is provided communicating from the fuel nozzle 17 to the downstream of the throttle valve 13. This is so as to ensure better particulation of the fuel in the low speed range of the engine. The output nozzle 41 sprays a certain amount of fuel into the intake passage, even if the throttle opening is small, into the strong vacuum area below the throttle valve. This amount is metered by the metering orifice 42. The strong vacuum improves much the particulation of this injected fuel. However, at high speed range of the engine, the vacuum at this point is approximately the same as the vacuum Po between the throttle valve 13 and the air valve 12, and therefore the majority of fuel at this time is supplied from the main opening of the nozzle 17, which has a small flow resistance.

Again, in this embodiment, the needle 16 is fixed to the back of the air valve 12 by the brackets 15, according to the present invention.

Figure 7:
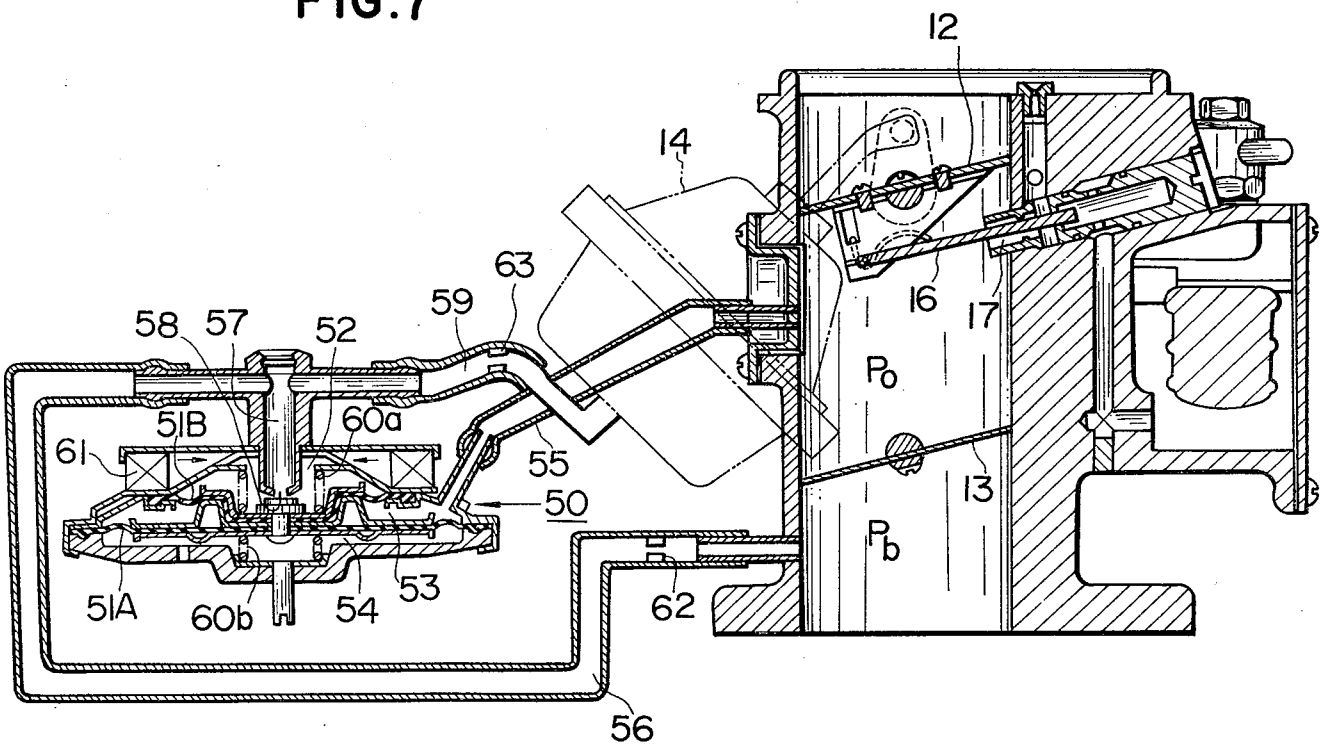
FIG. 7 is a sectional view of a third embodiment of the air valve carburetor of the present invention.

The embodiment of FIG. 7 shows the case in which the vacuum Po is not used directly to control the diaphragm device 14, but instead modifies vacuum taken from below the throttle valve 13, to produce a modulated vacuum Po', which is used to operate the diaphragm device 14. In detail, the servo valve 50 includes three chambers: an atmosphere dilution chamber 52, a vacuum introducing chamber 53, and a comparative atmosphere chamber 54, which are defined by diaphragms 51A and 51B which have different areas from one another. The vacuum Po from between the air valve 12 and the throttle valve 13 is introduced to the chamber 53 via the passage 55, and thereby the diaphragms 51A and 51B move in response to it. Near the valve body 58, attached to the diaphragms, a pipe 57 opens, which diverges from the pipe 56 which leads to the downstream of the throttle valve 13 via a metering element 62. Further, from the junction point of the pipes 57 and 56, a pipe 59 leads to the diaphragm chamber of the diaphragm device 14, via a metering element 63. Thereby, as the diaphragms 51A and 51B move up and down in the figure, air is selectively allowed to dilute the vacuum from below the throttle valve 13, before it actuates the diaphragm device 14. Thus this vacuum from below the throttle valve 13 functions merely as a source vacuum. In detail, when the vacuum Po becomes strong, the diaphragms move upwards in the figure, corresponding to the difference in their areas, and thereby the opening of the pipe 57 is more closed, and thereby more of the vacuum in the pipe 56 is allowed to operate the diaphragm device 14; and, conversely, when the vacuum Po becomes less, the diaphragms move down, and more air is allowed to dilute the vacuum in the pipe 56. Thus the vacuum Po' introduced to the diaphragm device 14 precisely depends on the vacuum Po.

The return spring 60*a* is provided in the chamber 52. The spring 60*b* in the chamber 54 enables the biasing force on the diaphragms to be adjusted. The air filter 61 is provided on the servo valve 50.

Figure 8:
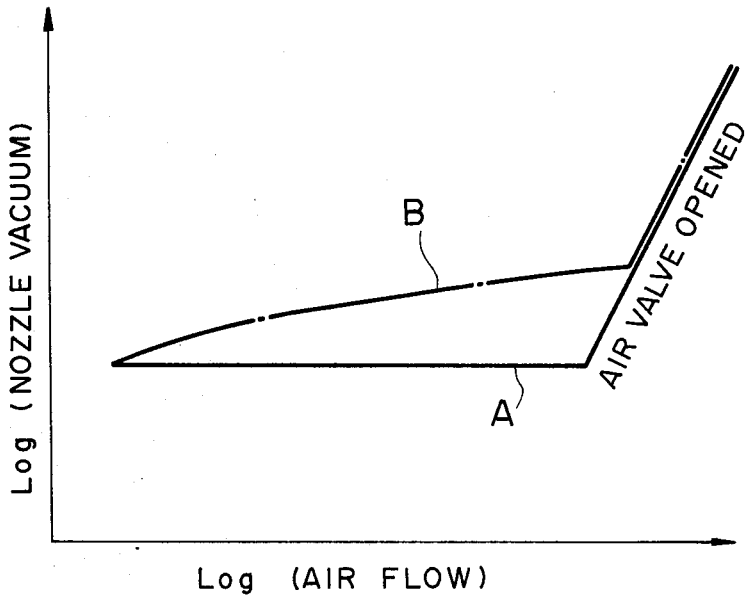
FIG. 8 is a graph showing an operational characteristic of the air valve carburetor shown in FIG. 7.

As shown in FIG. 8, the characteristic of the control vacuum Po' relative to the air flow can be maintained flat, as shown by curve A. On the other hand, if the servo valve 50 is not provided, the vacuum Po increases as shown by curve B, as the intake air flow increases, because the compression amount of the spring, not shown, of the diaphragm device 14 increases. This is because the return spring of the diaphragm device 14 is directly balanced by the vacuum Po, so that the energizing force of the spring increases in proportion to the displacement thereof. If it is balanced indirectly through the servo valve 50 by the vacuum Po', the diaphragm device 14 continues to operate until the passage vacuum becomes precisely Po.

This servo valve 50 has nothing to do with the present invention. As in the other two embodiments, in this embodiment also, the needle 16 is pivoted to the brackets 15 on the back of the air valve 12, according to the present invention.

Although the present invention has been shown and described with reference to several preferred embodiments, it should not be considered as limited to these, however, or mere and simple generalizations, or other detailed embodiments. Yet further modifications to the details of any particular embodiment could be made, without departing from the spirit of the present invention, or from its scope, and this scope is therefore only to be determined by the following claims.

We claim:

1. A carburetor for an internal combustion engine, comprising:

a body;

an intake passage formed in the body, circular in cross-section, leading to the engine;

a circular throttle valve mounted rotatably in the intake passage about one of its diameters;

a circular air valve mounted upstream of the throttle valve rotatably in the intake passage about one of its diameters, means for controlling said air valve in response to vacuum between said air valve and the throttle valve, so as to maintain that vacuum substantially constant;

a fuel nozzle opening into the intake passage between the throttle valve and the air valve; and a tapered needle having two ends, one end of which is inserted into the fuel nozzle so that it co-operates with the nozzle to provide a fuel opening which is varied in effective cross-section, as it moves in and out of the nozzle; and means fixed to the back of the air valve for pivotally supporting the other end of the needle, said supporting means including:

a bracket having a space therein, the bracket being fixed at a first portion away from said throttle valve to the side of the air valve closest to said throttle valve and having a slot formed in a second portion of the bracket closest to said throttle valve;

a joint pin having two ends passing laterally through the second portion of the bracket and connected pivotally at its center to said other end of the needle, each end of the joint pin being set in the slot of the bracket; and a spring biasing the joint pin toward a rearmost position of the slot.

2. A carburetor as in claim 1, further comprising a pipe arranged near the joining place of the needle to the bracket, and passing through the air valve from its upstream to its downstream side, so as to pass air to blow on the said end of the needle where it is pivoted to the bracket.

3. A carburetor as in claim 1, further comprising an auxiliary passage which connects the downstream of the portion of the nozzle which meters the fuel flow in co-operation with the needle with a point downstream of the throttle valve in the intake passage.

4. A carburetor as in claim 3, wherein the end of the auxiliary passage which opens into the intake passage downstream of the throttle valve protrudes into the intake passage.

5. A carburetor as in claim 1, further comprising:

wherein said controlling means comprises a diaphragm device which actuates the air valve;

a vacuum passage which connects a part of the intake passage downstream of the throttle valve to the diaphragm device; and a servo valve which injects atmospheric air into an intermediate part of the vacuum passage, in response to the vacuum between the air valve and the throttle valve.

6. A carburetor as in claim 5, wherein the servo valve comprises an amplifying diaphragm which is actuated in response to the vacuum between the air valve and the throttle valve to control the flow of diluting atmospheric air.

7. A carburetor for an internal combustion engine, comprising:

a body;

an intake passage formed in the body, circular in cross-section, leading to the engine;

a circular throttle valve mounted rotatably in the intake passage about one of its diameters;

a circular air valve mounted upstream of the throttle valve rotatably in the intake passage about one of its diameters, means for controlling said air valve in response to vacuum between said air valve and the throttle valve, so as to maintain that vacuum substantially constant;

a fuel nozzle opening into the intake passage between the throttle valve and the air valve;

a tapered needle having two ends, one end of which is inserted into the fuel nozzle so that it co-operates with the nozzle to provide a fuel opening which is varied in effective cross-section, as it moves in and out of the nozzle, the needle being tapered from its thickest portion away from the air valve to its thinnest portion nearer to the air valve so that the flow of fuel through the fuel nozzle is metered, the needle being tilted in such a way that the end of the needle which is positioned in the intake passage is lower than the other end thereof;

a pair of brackets formed as triangles and fixed at a first portion thereof in parallel to the downstream side of the air valve, each of the brackets having a notch or slot in the lower portion of the brackets at the side thereof away from the fuel nozzle;

a joint pin having two ends resting with its ends in the slots of the bracket and supporting pivotally the lower end of the needle; and a spring engaged around the ends of the joint pin for stopping the ends of the joint pin coming out of the slots of the bracket by biasing the ends of the joint pin toward the bottom of the slots.

8. The carburetor of claim 7, wherein the ends of the spring are supported by stopping means formed on the bracket, and the intermediate portions of the spring are wound around the ends of the joint pin in such a manner that the joint pin can be biased by the spring.

9. A carburetor as in claim 7, further comprising a pipe arranged near the joining place of the needle to the bracket, and passing through the air valve from its upstream to its downstream side, so as to pass air to blow on said end of the needle where it is pivoted to the bracket.

10. A carburetor as in claim 7, further comprising an auxiliary passage which connects the downstream of the portion of the nozzle which meters the fuel flow in cooperation with the needle with a point downstream of the throttle valve in the intake passage.

11. A carburetor as in claim 10, wherein the end of the auxiliary passage which opens into the intake passage downstream of the throttle valve protrudes into the intake passage.

12. A carburetor as in claim 7, further comprising:

a diaphragm device which actuates the air valve;

a vacuum passage which connects a part of the intake passage downstream of the throttle valve to the diaphragm device; and a servo valve which injects atmospheric air into an intermediate part of the vacuum passage, in response to the vacuum between the air valve and the throttle valve.

13. The carburetor of claim 12, wherein the servo valve includes an atmosphere dilution chamber, a vacuum introducing chamber and comparative atmosphere chamber, which are defined by a pair of diaphragms having different areas from one another, the vacuum from between the air valve and the throttle valve being introduced to the vacuum introducing chamber via the vacuum passage so that the diaphragms can move in response thereto.

* * * * *